US006640902B2

(12) United States Patent
Baten et al.

(10) Patent No.: US 6,640,902 B2
(45) Date of Patent: Nov. 4, 2003

(54) NESTED STACK-DOWN CASING HANGER SYSTEM FOR SUBSEA WELLHEADS

(75) Inventors: Robert B. Baten, Houston, TX (US); Harold B. Skeels, Kingwood, TX (US); David MacFarlane, Houston, TX (US); Russell E. McBeth, The Woodlands, TX (US); Randy J. Wester, Spring, TX (US); Marcus A. Smedley, Mesquite, TX (US)

(73) Assignee: FMC Technologies, Inc., Chicago, IL (US)

( * ) Notice: Subject to any disclaimer, the term of this patent is extended or adjusted under 35 U.S.C. 154(b) by 0 days.

(21) Appl. No.: 10/124,919

(22) Filed: Apr. 17, 2002

(65) Prior Publication Data

US 2003/0006041 A1 Jan. 9, 2003

Related U.S. Application Data

(60) Provisional application No. 60/284,307, filed on Apr. 17, 2001.

(51) Int. Cl.[7] ..... E21B 29/12

(52) U.S. Cl. ..... 166/368; 166/338; 166/344; 166/88.1; 166/89.1

(58) Field of Search ..... 166/338, 339, 166/340, 341, 342, 343, 344, 345, 368, 85.3, 88.1, 75.11, 179, 89.1

(56) References Cited

U.S. PATENT DOCUMENTS

| | | | | | |
|---|---|---|---|---|---|
| 3,334,924 | A | * | 8/1967 | Todd | 285/18 |
| 3,489,436 | A | | 1/1970 | Ahlstone | |
| 3,918,747 | A | * | 11/1975 | Putch | 285/4 |
| 3,937,251 | A | | 2/1976 | Ahlstone et al. | |
| 4,053,023 | A | * | 10/1977 | Herd et al. | 175/7 |
| 4,295,665 | A | * | 10/1981 | Pierce | 285/3 |
| 4,422,507 | A | * | 12/1983 | Reimert | 166/348 |
| 4,794,988 | A | * | 1/1989 | van Bilderbeek | 166/345 |
| 4,836,579 | A | | 6/1989 | Wester et al. | |
| 4,903,774 | A | * | 2/1990 | Dykes et al. | 166/363 |
| 4,911,244 | A | * | 3/1990 | Hynes | 166/368 |
| 5,127,478 | A | * | 7/1992 | Miller | 166/348 |
| 5,366,017 | A | | 11/1994 | Voss, Jr. | |
| 5,544,707 | A | * | 8/1996 | Hopper et al. | 166/382 |
| 5,620,052 | A | * | 4/1997 | Turner | 166/348 |
| 5,671,812 | A | * | 9/1997 | Bridges | 166/348 |
| 6,039,119 | A | * | 3/2000 | Hopper et al. | 166/368 |
| 6,513,596 | B2 | * | 2/2003 | Wester | 166/336 |

FOREIGN PATENT DOCUMENTS

| | | |
|---|---|---|
| GB | 2 285 077 A | 6/1995 |
| GB | 2 335 685 A | 9/1999 |
| GB | 2 358 204 A | 7/2001 |
| GB | 2 364 538 A | 1/2002 |

* cited by examiner

*Primary Examiner*—Robert E. Pezzuto
*Assistant Examiner*—Thomas A. Beach
(74) *Attorney, Agent, or Firm*—Henry C. Query, Jr.

(57) ABSTRACT

A wellhead system for petroleum producing wells comprises a "stack-down" casing hanger configuration. In this stack-down system, the hanger for each successively smaller diameter casing string is landed or "nested" within the hanger for the next larger casing string. This approach allows the pack-off for each casing hanger to be retrieved independently, thus allowing fluid communication to be established with any of the casing annuli after all of the casing strings and hangers have been installed. Thus the pressure in each annulus may be monitored while the well is in production mode.

16 Claims, 17 Drawing Sheets

NESTED STACK-DOWN CASING HANGER SYSTEM FOR SUBSEA WELLHEADS

This application is based on U.S. Provisional Patent Application No. 60/284,307, which was filed on Apr. 17, 2001.

BACKGROUND OF THE INVENTION

The present invention relates in general to subsea wellheads for oil and gas wells, and in particular to a nested stack-down casing hanger configuration which allows the pressure in the intermediate casing annuli to be monitored without penetrating the outer pressure containing housing or casing walls which separate the annuli from the external environment. Although the present invention has particular utility with respect to subsea wells, the invention is also applicable to land and offshore surface drilled wells.

In order to conform to various regulations and to protect life, property, and the environment, it is common practice on surface drilled wells to monitor the pressure in the various casing annuli for sustained casing head pressure (SCP). Pressure containing side outlets are provided in the casing and tubing heads, through which the annulus pressure can be measured. However, because such side outlets themselves create potential leak points, and because of the difficulty in detecting leaks, side penetrations in subsea wellhead housings are usually avoided. Exceptions are made in the regulations for high pressure subsea wells, such that it is required only to monitor pressure in the production annulus. In fact, such body penetrations are actually prohibited by some regulations. In any event, body penetrations in subsea wellheads could create potential hazards greater than those originally addressed by annulus monitoring.

Despite the difficulties inherent in monitoring annulus pressure in subsea wells, regulations have been proposed which would require that the pressure be monitored in every annulus in the well. Thus there is a need for a method of monitoring annulus pressure which does not require penetration of the pressure containing casings or housings. Even in the absence of such regulations, such a method would be most useful and desirable. Several prior art methods for monitoring annulus pressure in subsea wells are described in U.S. Pat. Nos. 5,544,707 and 4,887,672. A more complete discussion of the various regulations and the state of the prior art with respect to annulus pressure monitoring is presented in copending U.S. patent application Ser. No. 09/776,065, which is commonly owned herewith and the entirety of which is hereby incorporated by reference for all purposes.

Typical prior art wellhead systems have utilized a "stack-up" casing hanger configuration. In this type of system, the hanger for each successively smaller diameter casing string is landed on top of the hanger for the next larger casing string. Each hanger is locked and sealed to the wellhead housing bore above the next lower hanger. Thus, as each hanger is installed in the wellhead housing, the next lower hanger (and the associated annulus) becomes inaccessible.

For the purposes of illustration, a typical stack-up subsea wellhead system is shown in FIG. 1. The wellhead system comprises a conductor housing 12 attached atop conductor pipe 18 and locked into permanent guide base 10. The wellhead housing 14 is landed in the conductor housing 12 and includes wellhead bore 16. Second intermediate casing hanger 32 is landed in the wellhead housing 14 and supports second intermediate casing string 42. Hanger 32 is provided with annulus access port 36, which allows for fluid communication between the wellhead bore 16 and the "C" annulus 50 after installation of hanger 32. After the hanger 32 is landed in the wellhead housing 14, pack-off 34 is installed between hanger 32 and the wellhead housing 14, preventing further communication with access port 36.

First intermediate casing hanger 26 is then landed atop second intermediate casing hanger 32 and supports first intermediate casing string 40. Hanger 26 is provided with annulus access port 30, which allows for fluid communication between the wellhead bore 16 and the "B" annulus 48 after installation of hanger 26. After the hanger 26 is landed on hanger 32, pack-off 28 is installed between hanger 26 and the wellhead housing 14, preventing further communication with access port 30.

Production casing hanger 20 is then landed atop first intermediate casing hanger 26 and supports production casing string 38. Hanger 20 is provided with annulus access port 24, which allows for fluid communication between the wellhead bore 16 and the production or "A" annulus 46 after installation of hanger 20. The "A" annulus is located between the production casing string 38 and the production tubing, shown in phantom at 44. After the hanger 20 is landed on hanger 26, pack-off 22 is installed between hanger 20 and the wellhead housing 14, preventing further communication with access port 24. As is apparent from the figure, once all the casing hangers have been installed in the wellhead housing 14, access to the "B" and "C" annuli is prevented.

SUMMARY OF THE INVENTION

In accordance with the present invention, these and other disadvantages in the prior art are overcome by providing a wellhead system which comprises a wellhead housing and a plurality of concentric casing strings, each of which is suspended from a corresponding casing hanger. The casing hanger for the radially outermost casing string is supported in said wellhead housing and the casing hanger for each successively smaller casing string is supported in the casing hanger for the next radially larger casing string. Each casing string defines a corresponding annulus which surrounds said casing string and is located below the casing hanger for said casing string. Furthermore, at least one casing hanger comprises a bypass port or similar means for providing fluid communication between the annulus below said casing hanger and an area above said casing hanger.

Thus, the wellhead system of the present invention comprises a "stack-down" casing hanger configuration. In this type of system, the hanger for each successively smaller diameter casing string is landed or "nested" within the hanger for the next larger casing string. This approach allows the pack-off for each casing hanger to be retrieved independently, thus allowing fluid communication to be established with any of the casing annuli after all of the casing strings and hangers have been installed. Thus the pressure in each annulus may be monitored while the well is in production mode.

These and other objects and advantages of the present invention will be made apparent from the following detailed description, with reference to the accompanying drawings. In the drawings, the same reference numbers are used to denote similar components in the various embodiments.

DETAILED DESCRIPTION OF THE PREFERRED EMBODIMENTS

Figure 1:
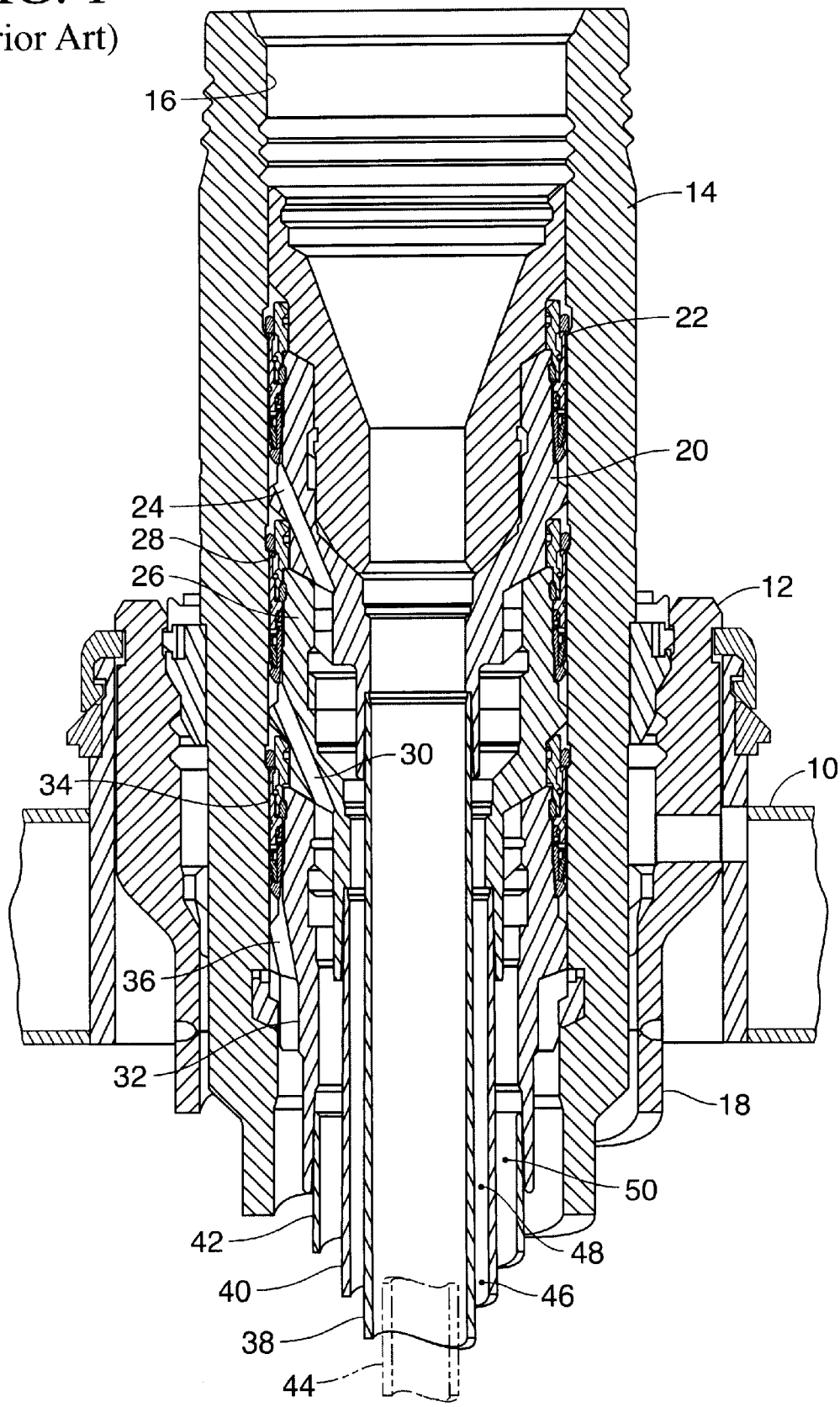
FIG. 1 (Prior Art)
FIG. 1 is a cross-sectional view of a prior art wellhead system having a stack-up casing hanger configuration.
Figure 2:
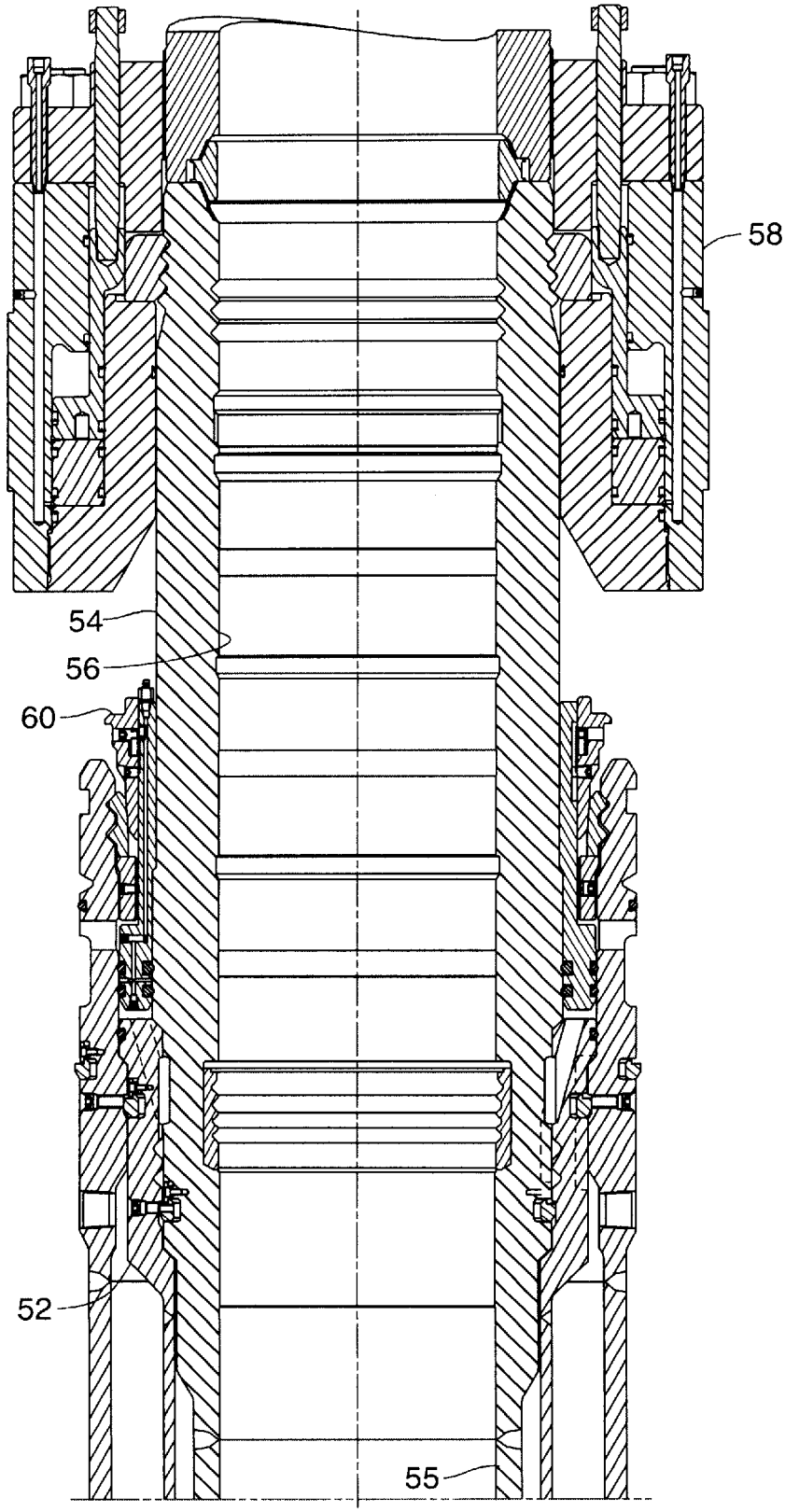
FIG. 2 is a cross-sectional view of the preferred embodiment subsea wellhead housing landed and locked in the stack-down wellhead, with the low-pressure drilling riser connected to the housing.

Referring to FIG. 2, the wellhead system of the present invention comprises a wellhead housing 54 which is landed in a stack-down wellhead 52. The lower end of wellhead housing 54 is welded or otherwise rigidly attached to an outer casing 55. Wellhead housing 54 is sealed and locked to stack-down wellhead 52 by a seal and lock assembly 60. Wellhead housing 54 further comprises a wellhead bore 56. A low pressure drilling riser connector 58 is locked and sealed to the upper end of wellhead housing 54.

Figure 3:
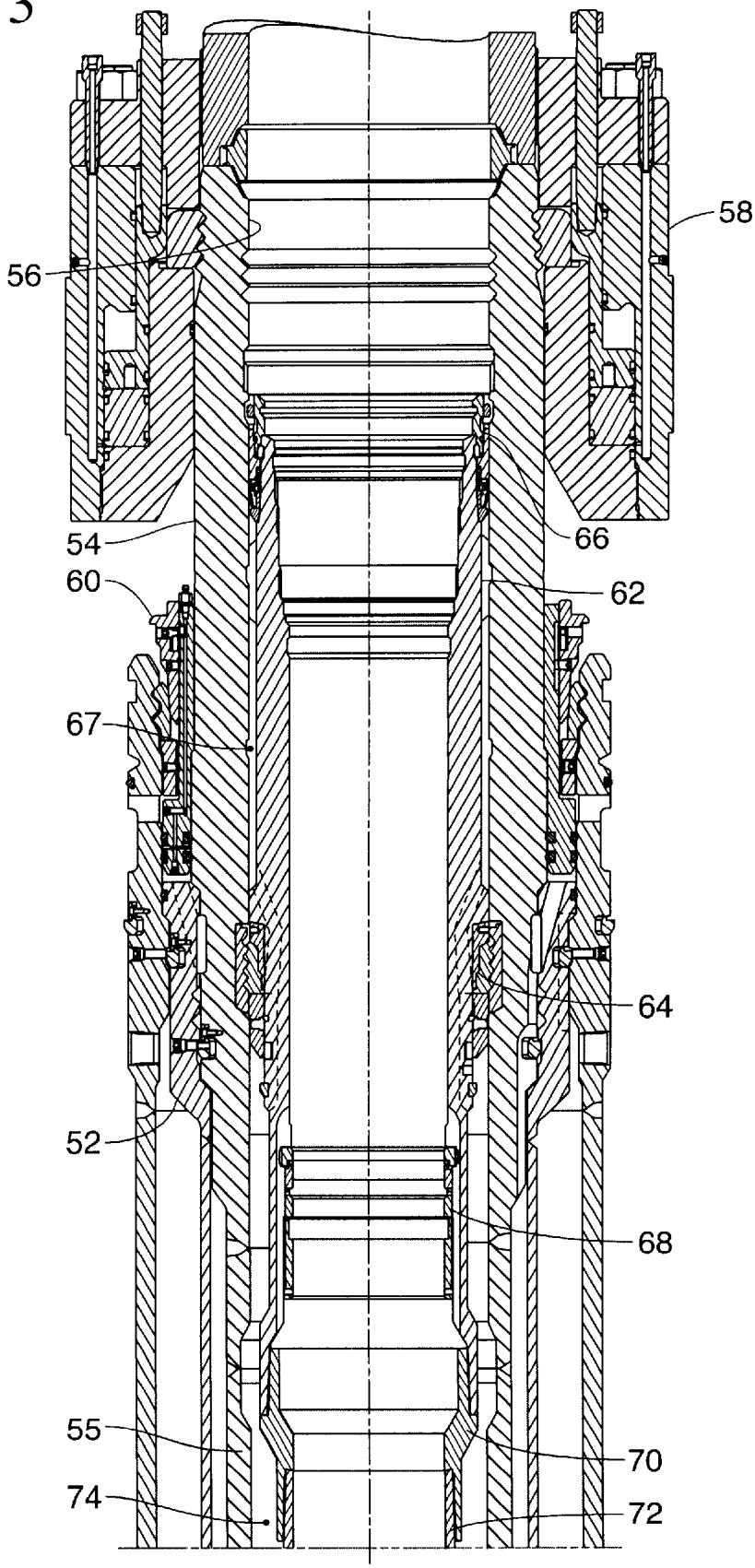
FIG. 3 is a cross-sectional view of the preferred embodiment subsea wellhead system with the intermediate casing hanger landed and locked in the wellhead housing.

Referring to FIG. 3, an intermediate casing hanger 62 is supported and locked within wellhead housing 54 by an expandable load shoulder 64. Suspended from hanger 62, via an adapter 70, is an intermediate casing string 72 which cooperates with outer casing 55 to define a "C" annulus 74. An annular space 67 is defined between hanger 62 and wellhead housing 54. A pack-off 66 isolates space 67 from wellhead bore 56. Intermediate casing hanger 62 further comprises a second expandable load shoulder 68, the purpose of which is described below.

Figure 4:
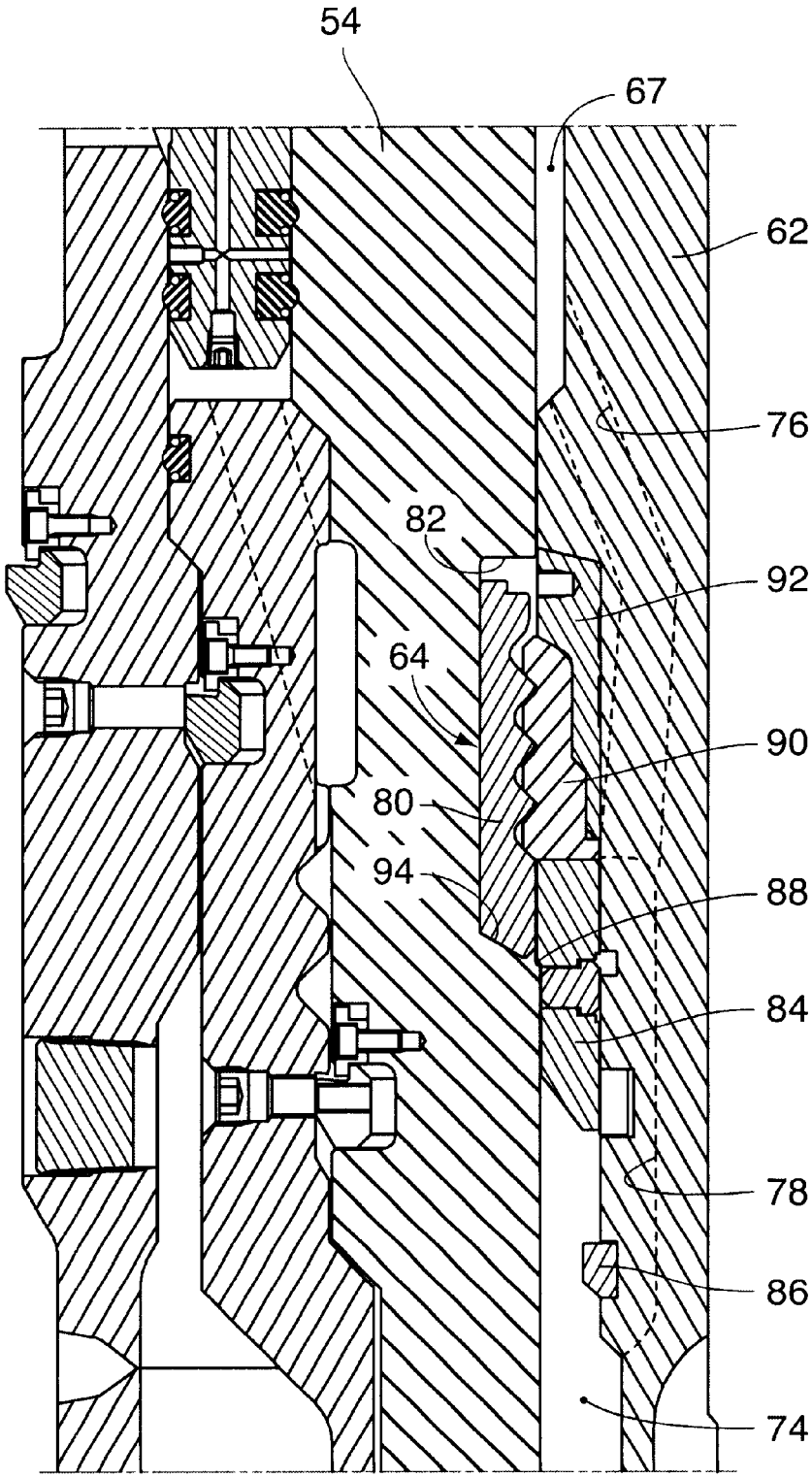
FIG. 4 is a close-up cross-sectional view of the expandable load shoulder mechanism for the intermediate casing hanger.

Referring to FIG. 4, expandable load shoulder 64 comprises an internally toothed ring 80, which resides in an internal groove 82 formed in wellhead housing 54. Load shoulder 64 further comprises a drive ring 84, an externally toothed ring 90, and a stepped insert 92, all of which are carried on intermediate casing hanger 62. Before hanger 62 is landed in wellhead housing 54, drive ring 84 and toothed ring 90 rest upon a support ring 86. As hanger 62 is landed, an external shoulder 88 on drive ring 84 impinges on a lower shoulder 94 of groove 82. As hanger 62 descends, drive ring 84 drives toothed ring 90 upward against stepped insert 92. Toothed ring 90 is thus cammed outward into locking engagement with internally toothed ring 80, and the weight of intermediate casing hanger 62 and intermediate casing string 72 are thus supported. Hanger 62 further comprises an annulus access port 76 which communicates with a groove 78. Port 76 and groove 78 provide for fluid communication between annular space 67 and "C" annulus 74, and thereby provide a fluid bypass around expandable load shoulder 64.

Figure 5:
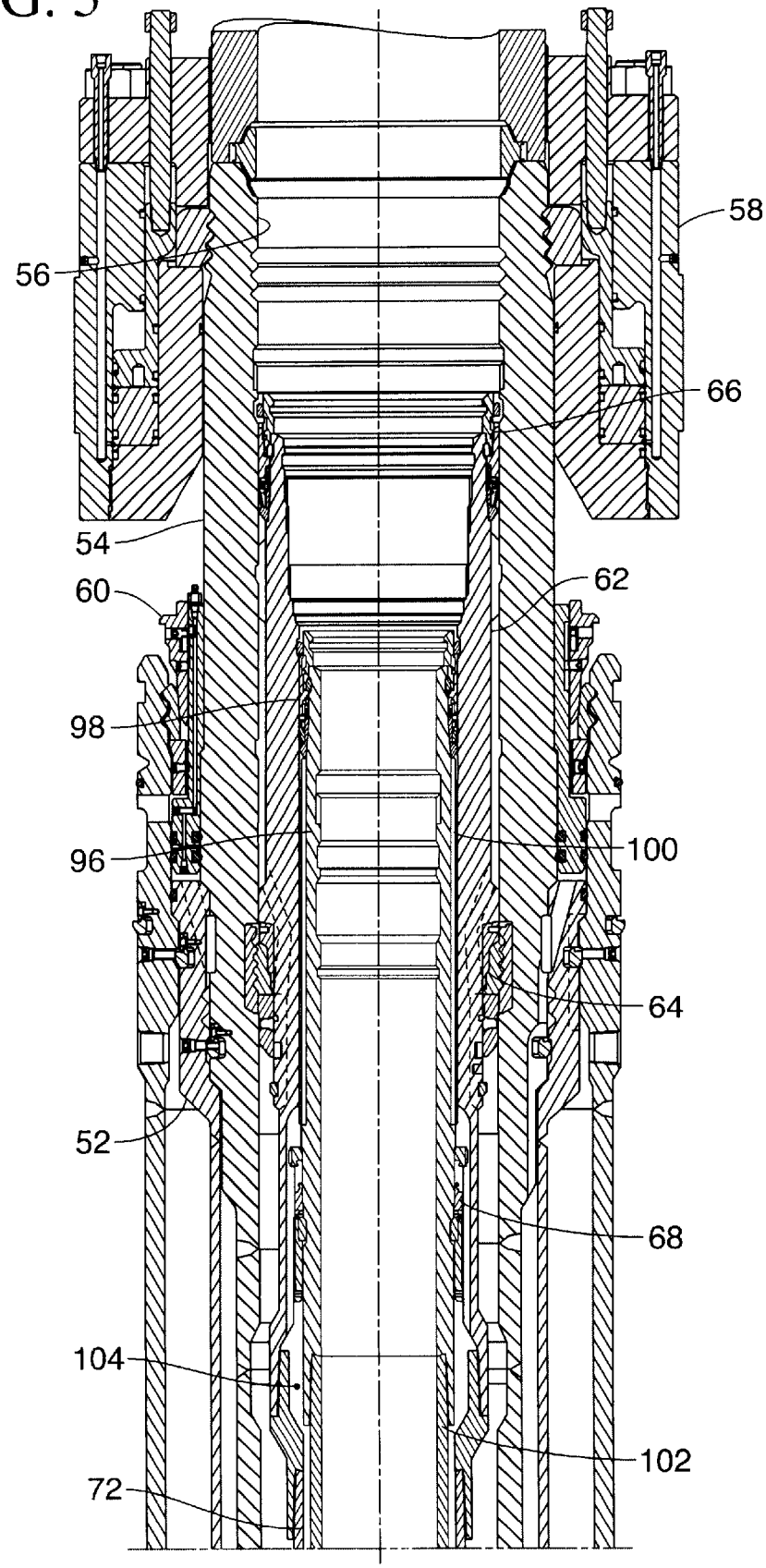
FIG. 5 is a cross-sectional view of the preferred embodiment subsea wellhead system with the production casing hanger landed and locked in the intermediate casing hanger.

Referring to FIG. 5, a production casing hanger 96 is supported and locked within intermediate casing hanger 62 by expandable load shoulder 68. Suspended from hanger 96 is a production casing string 102, which cooperates with intermediate casing string 72 to define a "B" annulus 104. An annular space 100 is defined between production casing hanger 96 and intermediate casing hanger 62. A pack-off 98 isolates space 100 from wellhead bore 56.

Figure 6:
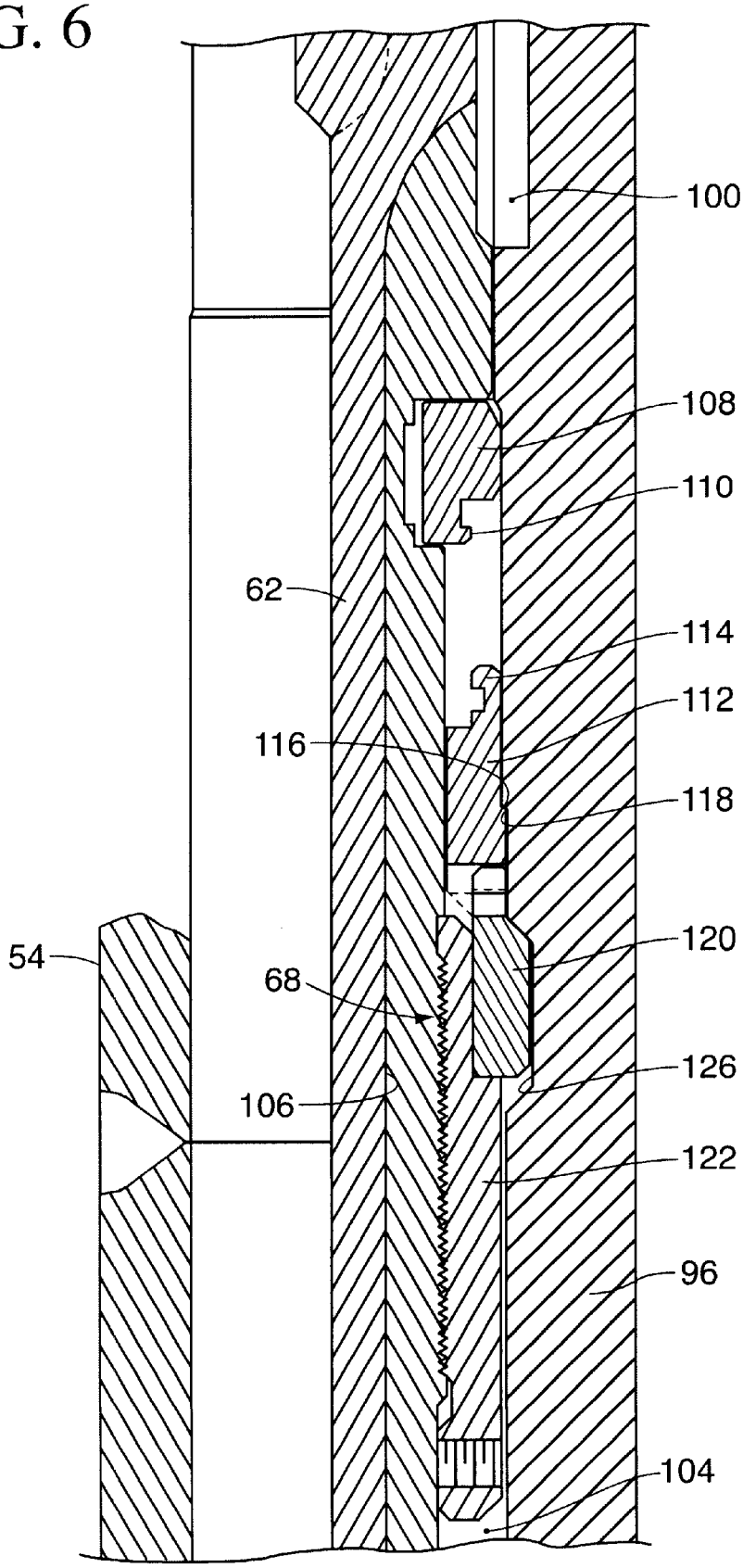
FIG. 6 is a close-up cross-sectional view of the expandable load shoulder mechanism for the production casing hanger.

Referring to FIG. 6, expandable load shoulder 68 comprises a retainer ring 108, which is carried by intermediate casing hanger 62 and includes an internal lower lip 110. Load shoulder 68 further comprises a lock ring 120 and an energizing mandrel 112, which includes an external upper lip 114. A locking mandrel 122 is threadedly connected to hanger 62. Before production casing hanger 96 is landed in intermediate casing hanger 62, energizing mandrel 112 is suspended from retainer ring 108 via engagement of lips 114 and 110. Lock ring 120, which is outwardly biased, is disposed below mandrel 112. As production casing hanger 96 descends, an external shoulder 118 on hanger 96 impinges upon an internal shoulder 116 on energizing mandrel 112. Lips 114 and 110 disengage, and mandrel 112 drives lock ring 120 downward. As lock ring 120 contacts locking mandrel 122, lock ring 120 is cammed inward into a groove 126 in hanger 96, and the weight of hanger 96 and production casing string 102 are thus supported. Adjacent to expandable load shoulder 68, intermediate casing hanger 62 is provided with an internal slot 106. Slot 106 provides for fluid communication between annular space 100 and the "B" annulus 104, and thereby provides a fluid bypass around expandable load shoulder 68.

Figure 7:
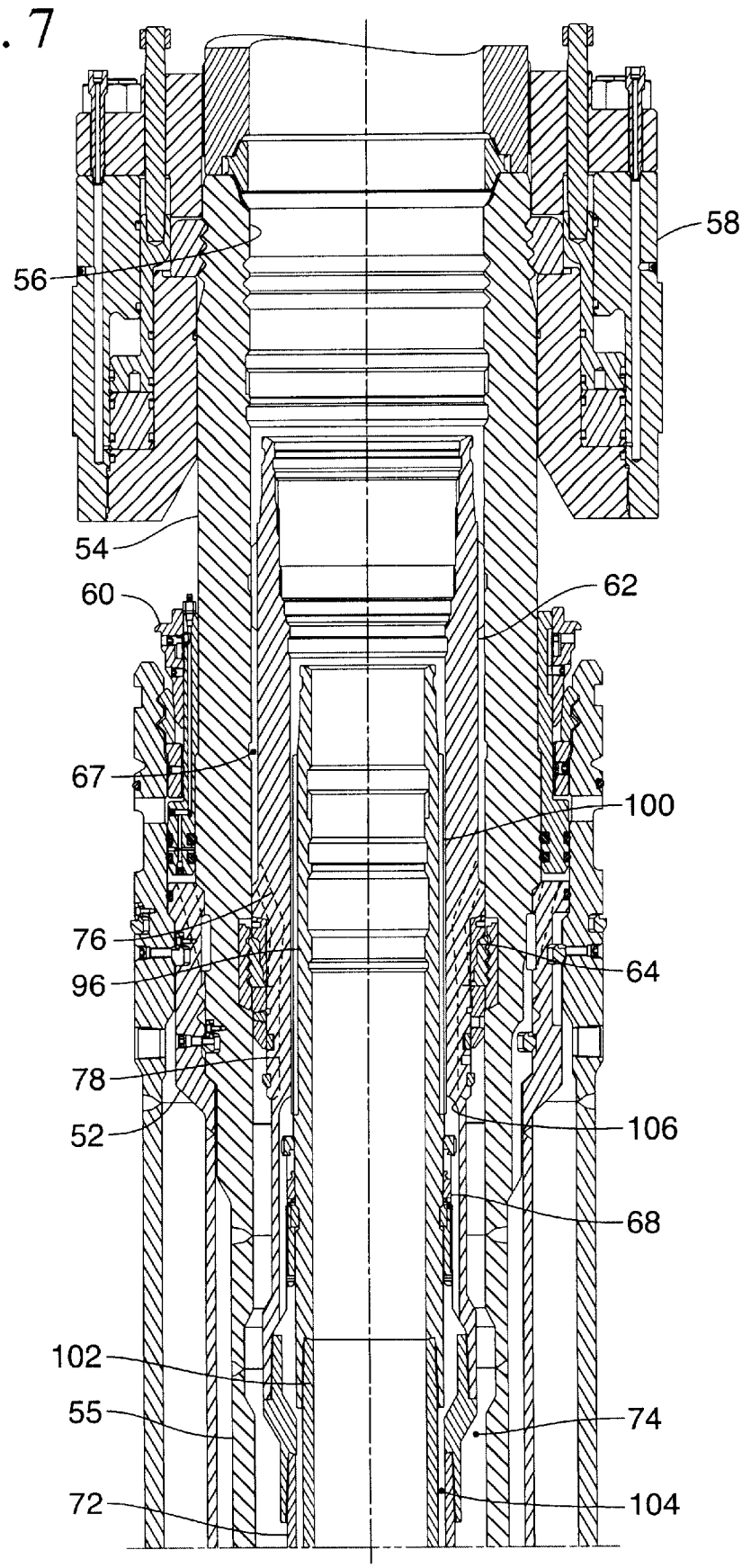
FIG. 7 is a cross-sectional view of the preferred embodiment subsea wellhead system with the casing hanger pack-offs retrieved.
Figure 8:
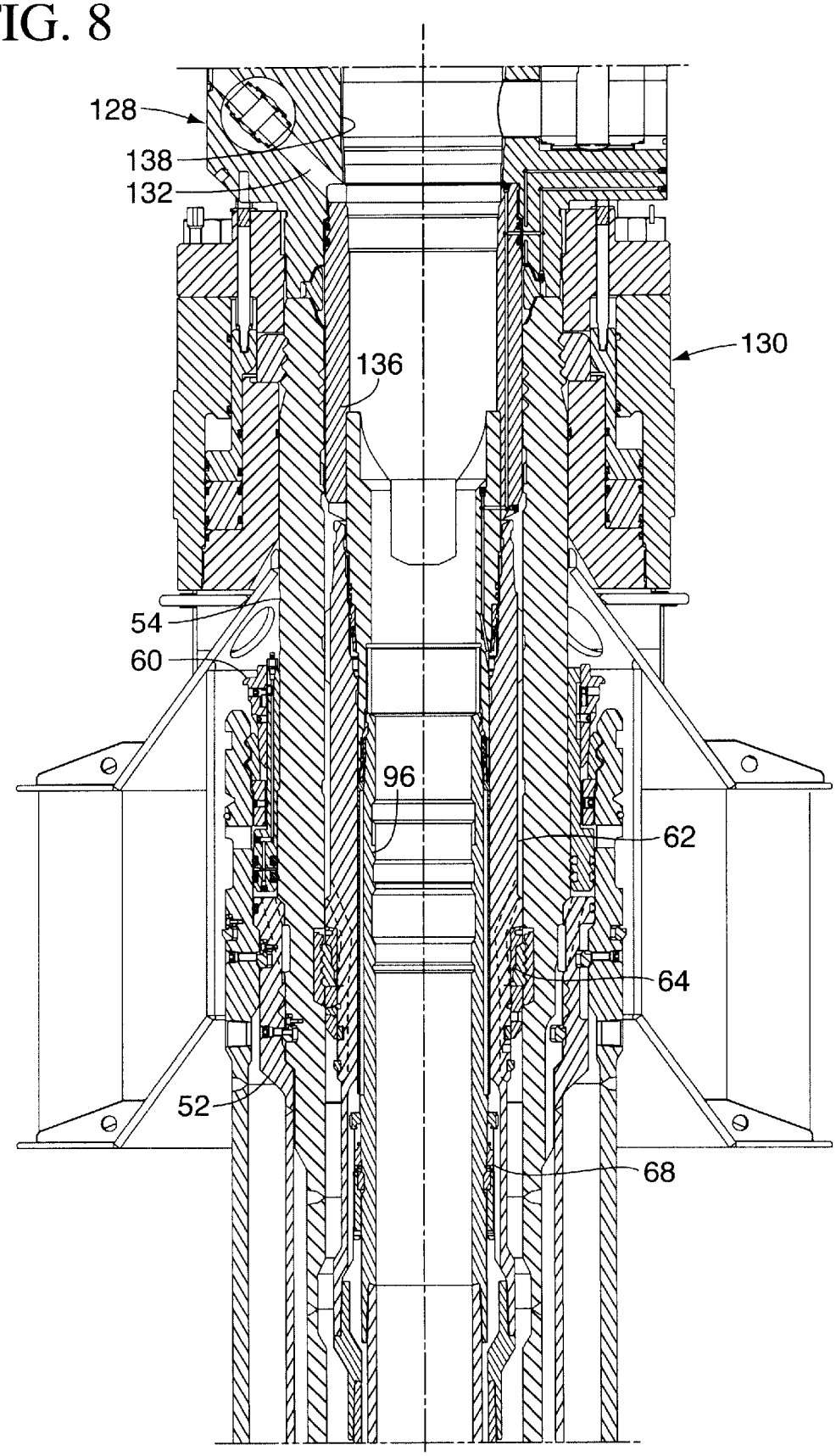
FIG. 8 is a cross-sectional view of the preferred embodiment subsea wellhead system with a horizontal Christmas tree connected to the top of the wellhead housing.

FIG. 7 shows the wellhead system of the present invention with both of the pack-offs retrieved in preparation for the production mode. Referring to FIG. 8, a subsea Christmas tree 128 is connected to the upper end of wellhead housing 54 via a connector 130. A stab 136 extends from tree 128 into the wellhead housing 54 and engages intermediate casing hanger 62. Christmas tree 128 further comprises a tree bore 138 and an annulus port 132. When the production tubing and tubing hanger (not shown) are installed in the tree 128, the annulus port 132 provides access to the production or "A" annulus between the production tubing and the production casing 102. Thus the pressure in the production annulus may be monitored during production.

Figure 9:
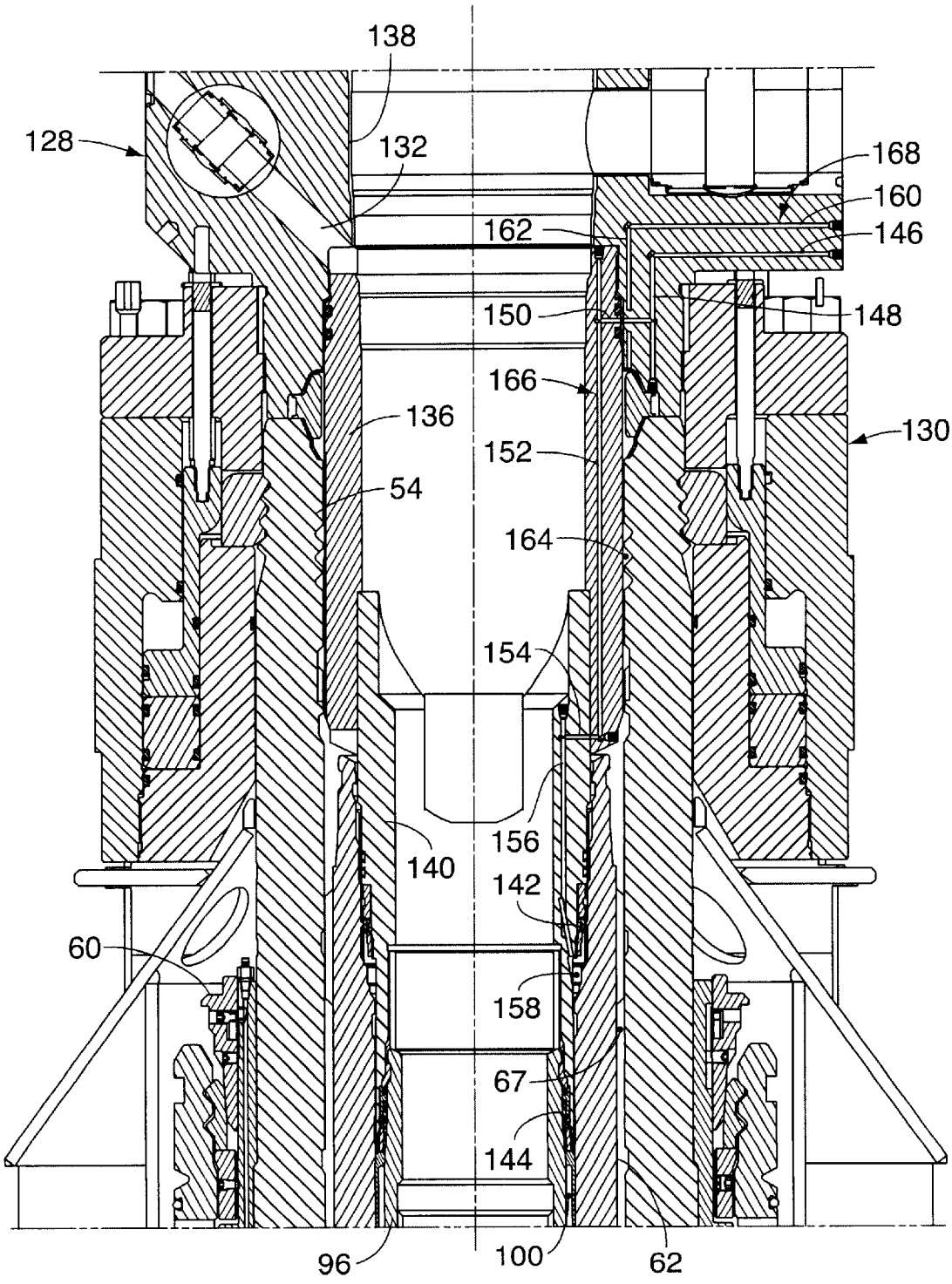
FIG. 9 is a close-up cross-sectional view of the lower portion of the Christmas tree shown in FIG. 8.

Referring to FIG. 9, the pressure in the "B" annulus 104 may be monitored via a fluid path 166. Path 166 comprises legs 146 and 148 in the tree 128. Leg 146 exits the OD of tree 128 and may be connected to an external gage or other means for monitoring pressure. A leg 150 passes from the tree 128 into the stab 136. A leg 152 continues longitudinally through stab 136 and intersects a leg 154, which then passes into a lower section 140 of stab 136. Leg 154 intersects a leg 156, which continues longitudinally through lower section 140 and exits into a space 158. Space 158 is defined below a seal assembly 142, which seals between hanger 62 and lower portion 140. Space 158 is in fluid communication with annular space 100, which has already been shown to communicate with the "B" annulus 104. Thus path 166 is in fluid communication with the "B" annulus 104 and can be used to monitor the pressure therein.

Pressure in the "C" annulus 74 may be measured via a fluid path 168. Path 168 comprises legs 160 and 162 in tree 128. Leg 162 is in fluid communication with a space 164 which is defined between stab 136 and wellhead housing 54. Space 164, in turn, is in fluid communication with space 67, which has already been shown to communicate with the "C" annulus 74. Thus path 168 is in fluid communication with the "C" annulus 74 and can be used to monitor the pressure therein.

Alternative Embodiments

Figure 10:
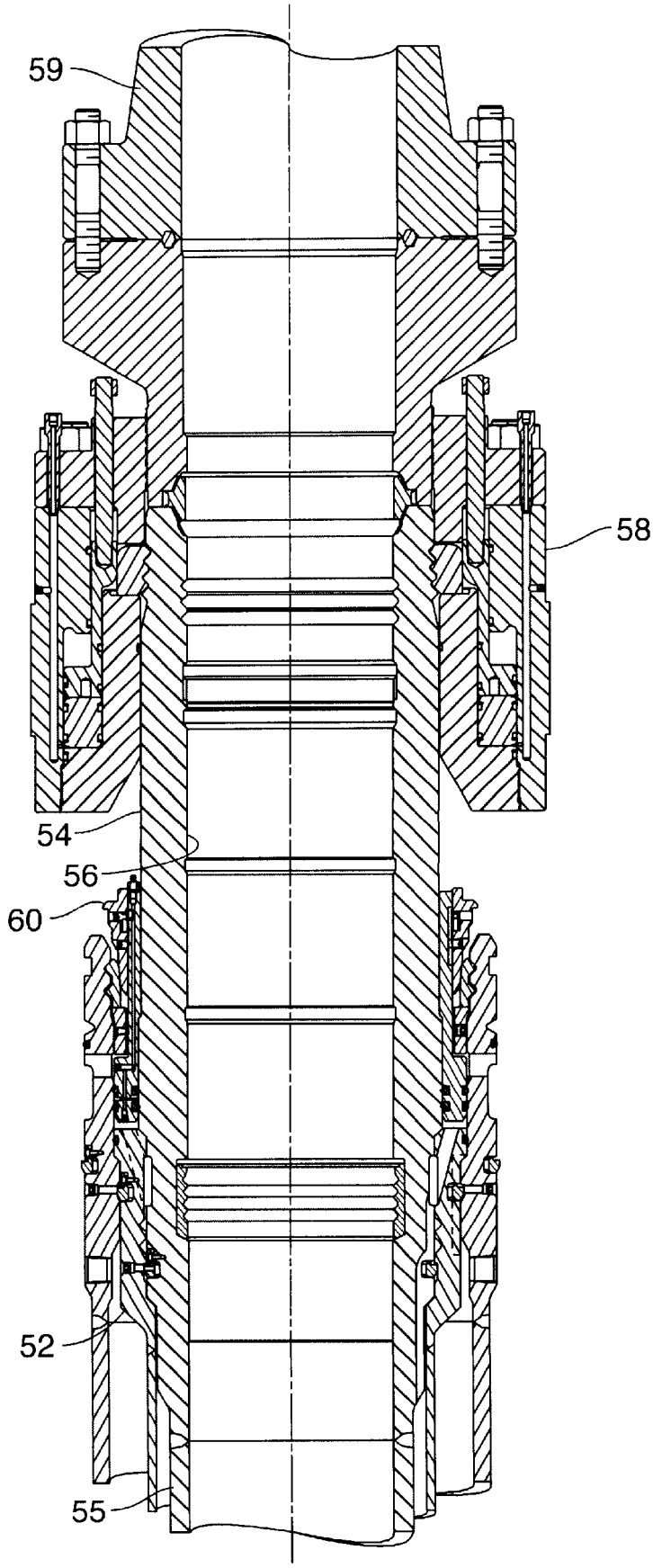
FIG. 10 is a cross-sectional view of an alternative embodiment surface drilled wellhead housing landed and locked in the stack-down wellhead, with the low-pressure drilling riser connected to the housing.
Figure 11:
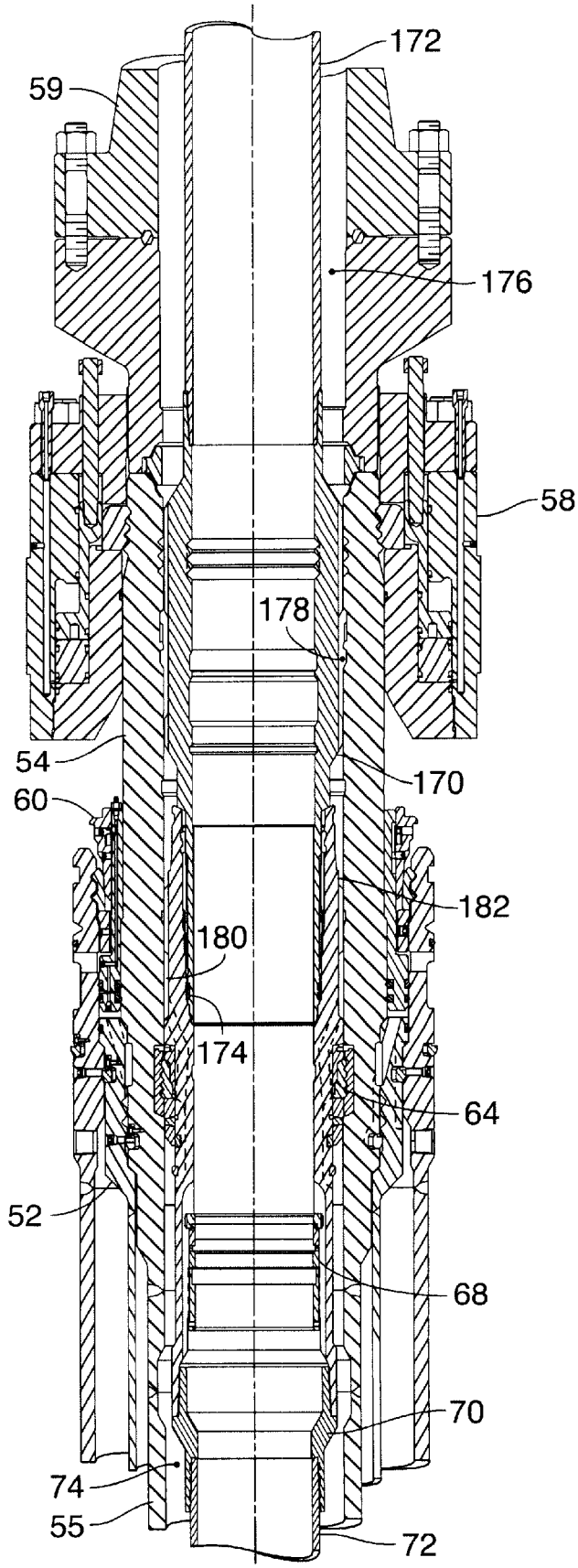
FIG. 11 is a cross-sectional view of the alternative embodiment surface drilled wellhead system with the intermediate casing hanger landed and locked in the wellhead housing, and the high pressure drilling riser engaging the intermediate casing hanger.

The present invention may also be utilized in a surface drilled well. Referring to FIG. 10, prior to completion the surface drilled system is essentially identical the subsea case (compare with FIG. 2). Referring to FIG. 11, an intermediate casing hanger 182 is landed in the wellhead housing 54 and locked therein via expandable load shoulder 64, in a manner similar to the subsea case. A low pressure drilling riser 59 is attached to wellhead housing 54 via low pressure drilling riser tieback 58. A high pressure drilling riser 172 is connected to hanger 182 via a high pressure drilling riser tieback 170. An annular space 178 is defined between tieback 170 and wellhead housing 54. An annular space 180 is defined between hanger 182 and wellhead housing 54. A riser annulus 176 is defined between high pressure drilling riser 172 and low pressure drilling riser 59. It should be understood that in the configuration shown in FIG. 11, annulus 176 is in fluid communication with both the tree at the surface and the "C" annulus 74 via space 180. Thus the pressure in the "C" annulus 74 may be monitored from the surface.

Figure 12:
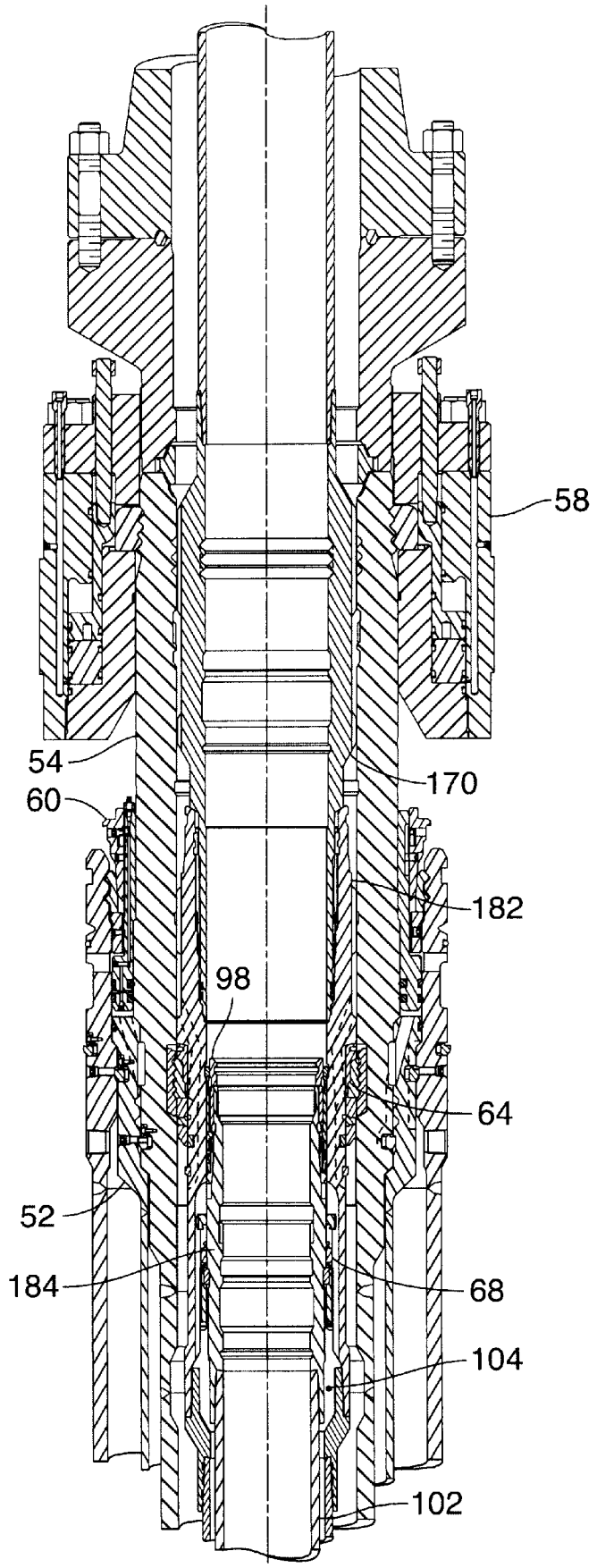
FIG. 12 is a cross-sectional view of the alternative embodiment surface drilled wellhead system with the production casing hanger landed and locked in the intermediate casing hanger.
Figure 13:
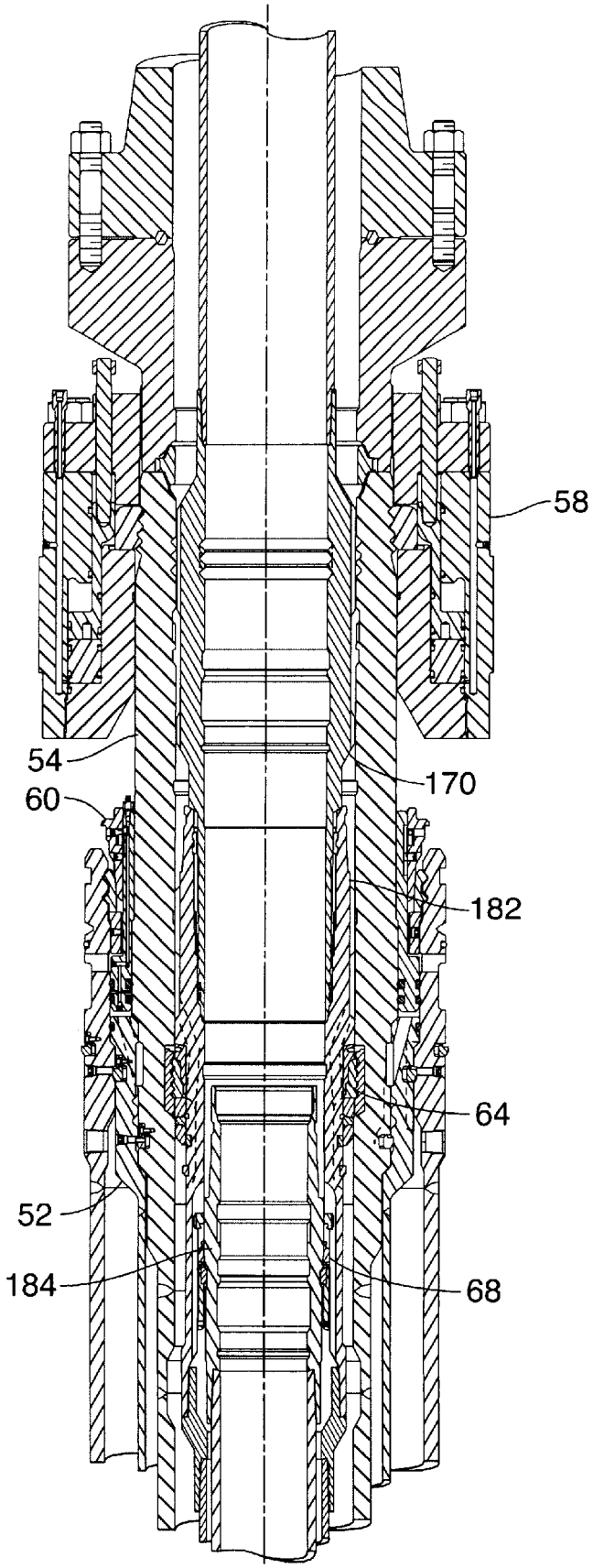
FIG. 13 is a cross-sectional view of the alternative embodiment surface drilled wellhead system with the production casing hanger pack-off retrieved.
Figure 14:
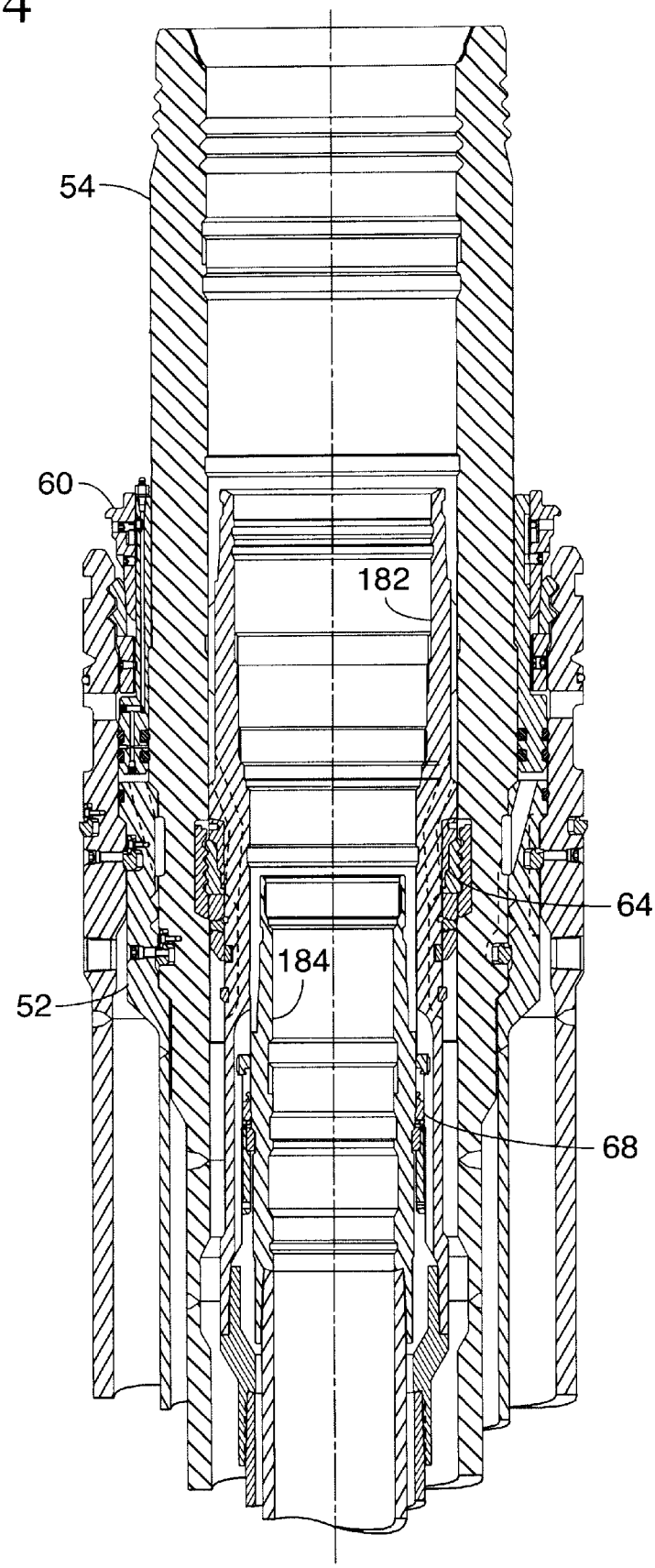
FIG. 14 is a cross-sectional view of the alternative embodiment surface drilled wellhead system with both casing hanger pack-offs retrieved.

Referring to FIG. 12, a production casing hanger 184 is landed within intermediate casing hanger 182 and is locked therein via expandable load shoulder 68. Pack-off 98 seals between hanger 182 and hanger 184. FIG. 13 shows the wellhead system with pack-off 98 retrieved. FIG. 14 shows the wellhead system with both pack-offs retrieved and the low pressure drilling riser tieback disengaged.

Figure 15:
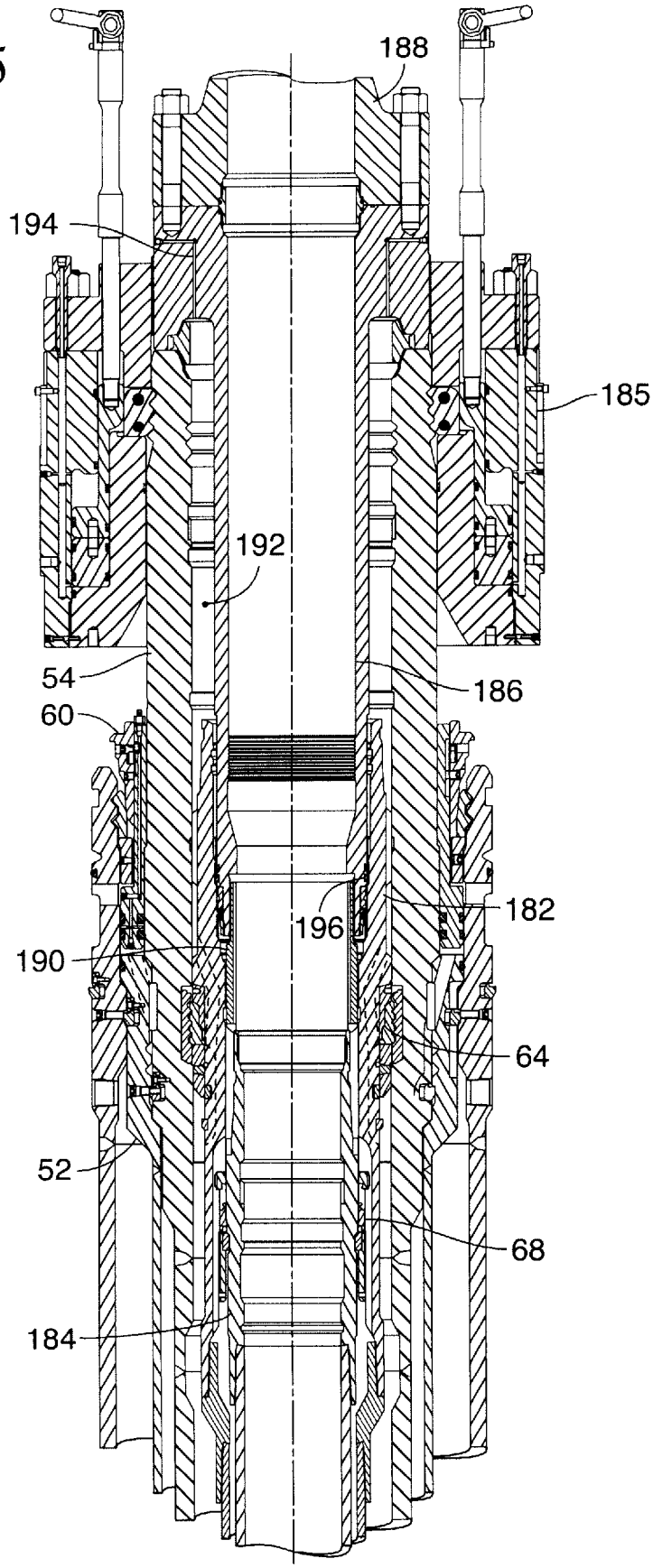
FIG. 15 is a cross-sectional view of the alternative embodiment surface drilled wellhead system with the external production tieback connector engaging the intermediate casing hanger.

Referring to FIG. 15, an external production riser 188 is connected to wellhead housing 54 via an external production tieback connector 185. An external production tieback 186 is attached to intermediate casing hanger 182 via a lock down nose 190 and is sealed thereto via a seal 196. An annular space 192 is defined between wellhead housing 54 and tieback 186. An annulus monitoring port 194 provides fluid communication between annular space 192 and the exterior of tieback 186 and may be connected to a gauge or other pressure monitoring means.

Figure 16:
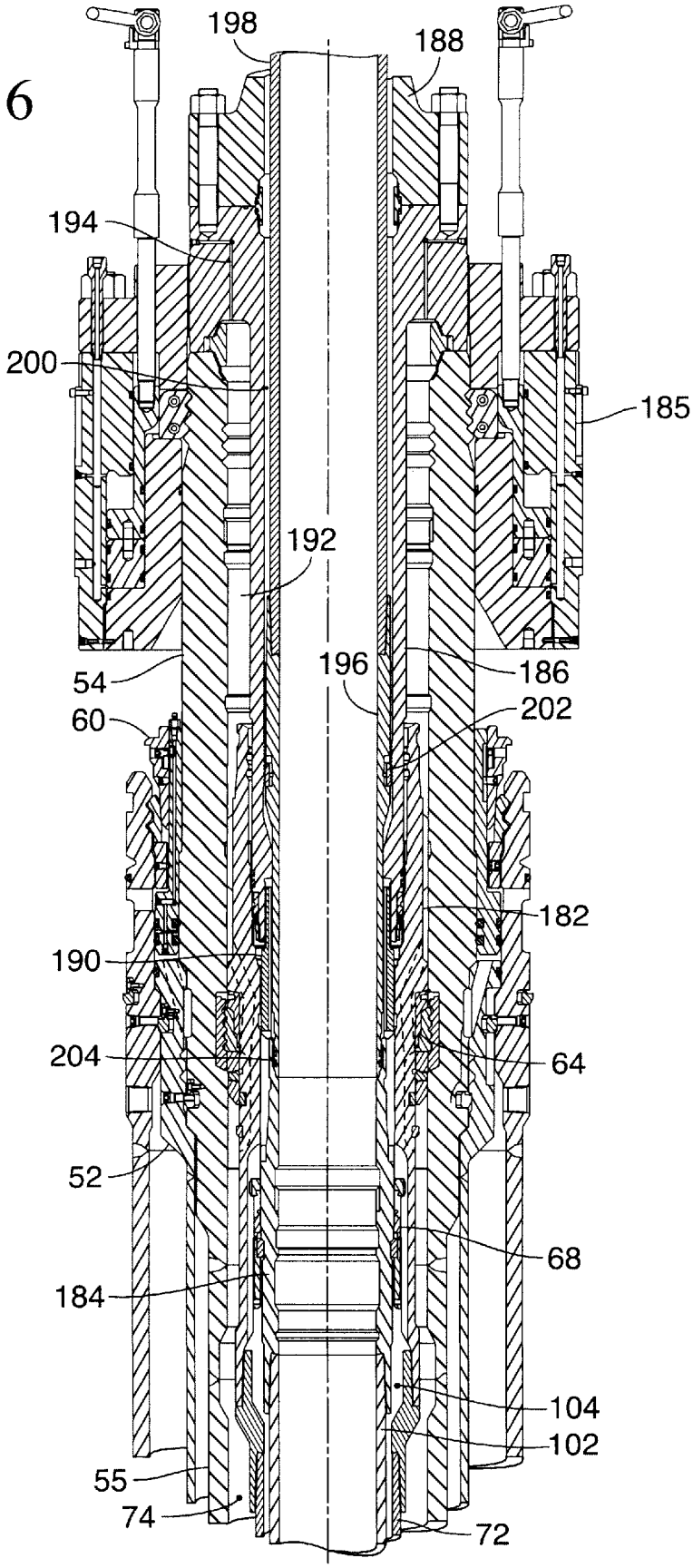
FIG. 16 is a cross-sectional view of the alternative embodiment surface drilled wellhead system with the internal production tieback connector engaging the production casing hanger.

Referring to FIG. 16, an internal production riser 198 is connected to external production tieback 186 via an internal production tieback connector 196 and a ratch-latch mechanism 202. Connector 196 is sealed to production casing hanger 184 via a seal 204. An annular space 200 is defined between internal production riser 198 and external production tieback 186. It should be understood that in the configuration shown in a FIG. 16, annulus 200 is in fluid communication both with the tree at the surface and the "B" annulus 104.

Figure 17:
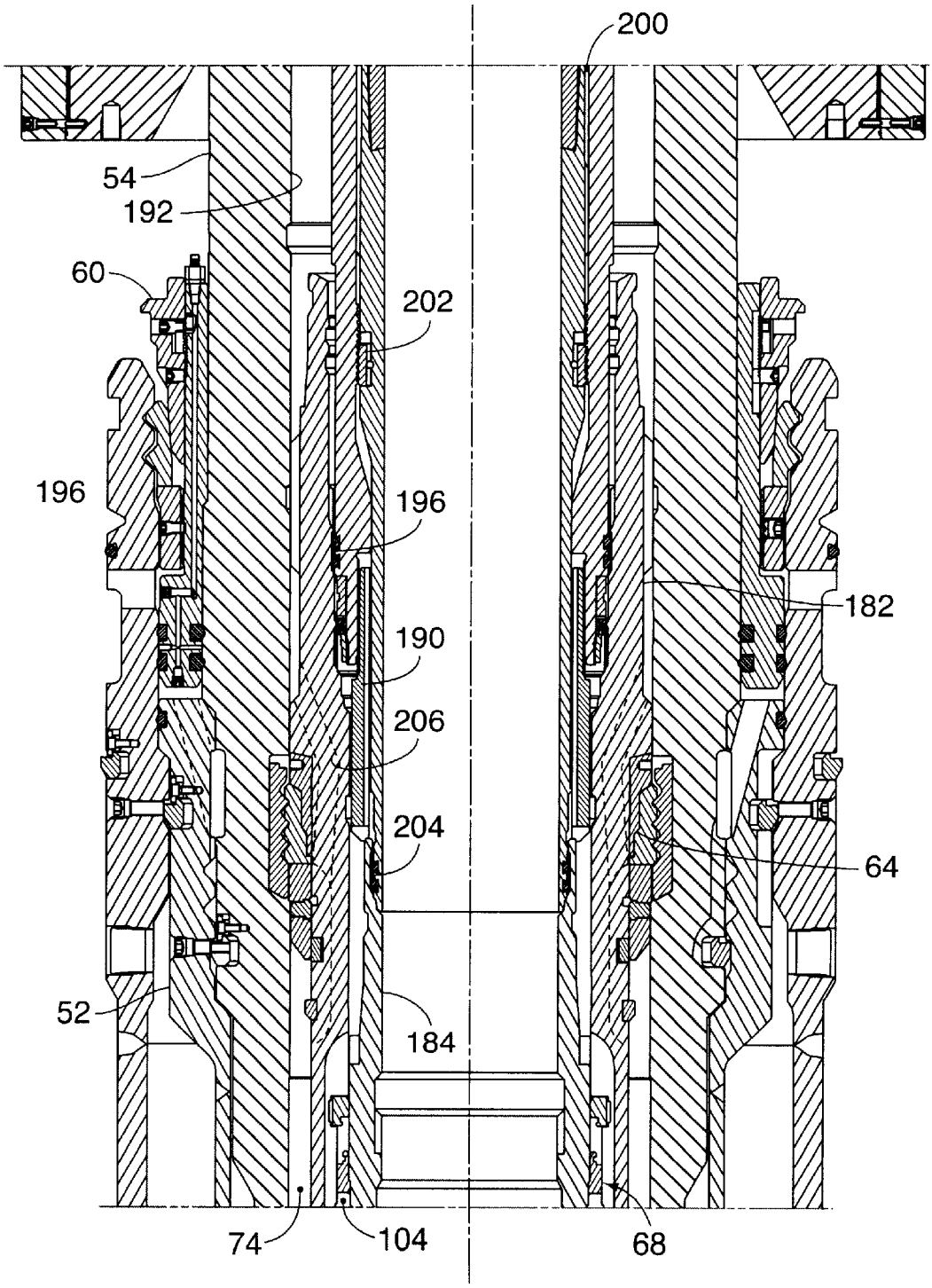
FIG. 17 is a close-up cross-sectional view of the internal production tieback connector engaging the production casing hanger.

Referring to FIG. 17, the communication path between annulus 200 and annulus 104 can be seen to bypass ratch-latch 202 and lock down nose 190 and continue on to the "B" annulus 104 in a manner similar to the subsea case. A communication path can also be traced between annulus 192 and the "C" annulus 74 via an annulus access port 206 in hanger 182. Since annulus 192 communicates with monitor port 194, the pressure in the "C" annulus 74 may be monitored during production.

The embodiments here presented are at present considered to be the best modes for carrying out the invention. However, it should be understood that variations in the shape, number, and arrangement of the various elements may be made without parting from the true spirit and scope of the invention. Therefore, it is the applicant's intent to claim all such variations as fall within the scope of the invention.

What is claimed is:

1. A wellhead system which includes:

a wellhead housing;

a first casing hanger which is supported in the wellhead housing and from which a first casing string is suspended;

a second casing hanger which is supported in the first casing hanger and from which a second casing string is suspended;

a first casing annulus being formed between the wellhead housing and the first casing string, and a second casing annulus being formed between the first casing string and the second casing string;

a first removable sealing member which is positioned between the first casing hanger and the wellhead housing; and a second removable sealing member which is positioned between the second casing hanger and the first casing hanger;

wherein the first and second sealing members may be independently removed to provide selective access to the first and second casing annuli from above the first and second casing hangers.

2. The wellhead system of claim 1, further comprising a Christmas tree which is mounted to the wellhead housing and which includes a first pressure monitoring port and a first fluid path that communicates with both the first pressure monitoring port and one of the first and second casing annuli.

3. The wellhead system of claim 2, wherein the Christmas tree further comprises a depending stab which engages the second casing hanger, and wherein the first fluid path extends at least partially through the stab and communicates with the second casing annulus.

4. The wellhead system of claim 2, wherein the Christmas tree further comprises a second pressure monitoring port and a second fluid path that communicates with both the second pressure monitoring port and the other of the first and second casing annuli.

5. The wellhead system of claim 1, further comprising:

a first tubular production member which is connected to the first casing hanger;

a first annular space being defined between the first production member and the wellhead housing;

wherein the first production member comprises a first pressure monitoring port and a first fluid passage that extends from the first pressure monitoring port and communicates with the first casing annulus via the first annular space.

6. The wellhead system of claim 5, wherein the first production member comprises an external production riser which is connected to the wellhead housing and an external production tieback which is sealed to the first casing hanger.

7. The wellhead system of claim 5, further comprising:

a second tubular production member which is positioned within and connected to the first production member;

a second annular space being defined between the first and second production members;

wherein the second annular space communicates with both the second casing annulus and a surface tree to which the first and second production members are connected.

8. The wellhead system of claim 7, wherein the second production member comprises an internal production riser which is connected to the first production member and an internal production tieback connector which is sealed to the second casing hanger.

9. The wellhead system of claim 7, wherein the first production member comprises an external production riser which is connected to the wellhead housing and an external production tieback which is sealed to the first casing hanger, and wherein the second production member comprises an internal production riser which is connected to the external production tieback and an internal production tieback connector which is sealed to the second casing hanger.

10. The wellhead system of claim 1, further comprising first means for locking the first casing hanger to the wellhead housing.

11. The wellhead system of claim 10, wherein the first locking means comprises:

an internally toothed ring which is supported on the wellhead housing;

an externally toothed ring which is movably supported on the first casing hanger; and means for engaging the externally toothed ring with the internally toothed ring.

12. The wellhead system of claim 11, wherein the engaging means comprises:

a drive ring which is movably supported on the first casing hanger below the externally toothed ring; and an insert which is immovably supported on the first casing hanger above the externally toothed ring;

wherein as the first casing hanger is landed in the wellhead housing, the drive ring will contact the wellhead housing and force the externally toothed ring upward over the insert, which in turn will force the externally toothed ring radially outwardly into engagement with the internally toothed ring to thereby lock the first casing hanger to the wellhead housing.

13. The wellhead system of claim 10, wherein the first casing hanger comprises a fluid passage extending from the first casing annulus to an annular area between the first casing hanger and the wellhead housing above the first locking means.

14. The wellhead system of claim 1, further comprising second means for locking the second casing hanger to the first casing hanger.

15. The wellhead system of claim 14, wherein the second locking means comprises:

a lock ring which is connected to an energizing mandrel that is movably supported on the first casing hanger; and a locking mandrel which is immovably supported on the first casing hanger;

wherein as the second casing hanger is landed in the first casing hanger, the second casing hanger will force the energizing mandrel downward and bring the lock ring into engagement with the locking mandrel, which in turn will force the lock ring radially inwardly into engagement with a corresponding groove on the second casing hanger to thereby lock the second casing hanger to the first casing hanger.

16. The wellhead system of claim 14, wherein at least one of the first and second casing hangers comprises a fluid passage extending from the second casing annulus to an annular area between the first casing hanger and the second casing hanger above the second locking means.

* * * * *